US005570840A

United States Patent [19]

Gettinger et al.

[11] Patent Number: 5,570,840

[45] Date of Patent: Nov. 5, 1996

[54] HAND-HELD SPRAYING APPARATUS

[75] Inventors: Thomas Gettinger, West Bloomfield; Joel Hetrick, Ann Arbor, both of Mich.

[73] Assignee: Fourth and Long, Inc., West Bloomfield, Mich.

[21] Appl. No.: 323,264

[22] Filed: Oct. 14, 1994

[51] Int. Cl.[6] ..... B05B 15/02; B05B 9/043

[52] U.S. Cl. ..... 239/112; 239/333; 239/361; 239/370

[58] Field of Search ..... 239/361, 360, 239/329, 355, 371, 330, 353, 361, 112, 106; 222/207, 211, 212, 382, 383

[56] References Cited

U.S. PATENT DOCUMENTS

| | | | |
|---|---|---|---|
| 1,020,833 | 3/1912 | Manning | 239/371 X |
| 1,930,872 | 10/1933 | Blackmun . | |
| 3,125,298 | 3/1964 | Iwata . | |
| 3,229,151 | 3/1966 | Jokelson | 239/355 X |
| 3,768,734 | 10/1973 | Anderson et al. | 239/330 X |
| 4,024,992 | 5/1977 | Schmid . | |
| 4,051,983 | 10/1977 | Anderson . | |
| 4,216,882 | 8/1980 | Basile et al. . | |
| 4,393,984 | 7/1983 | Debard . | |
| 4,411,387 | 10/1983 | Stern et al. | 239/371 X |
| 4,492,320 | 1/1985 | Tada . | |
| 4,618,076 | 10/1986 | Silvenis . | |
| 4,646,969 | 3/1987 | Sorm et al. . | |
| 4,972,977 | 11/1990 | Moss et al. . | |
| 5,025,958 | 6/1991 | Montaner et al. . | |
| 5,088,649 | 2/1992 | Hanson et al. . | |
| 5,100,029 | 3/1992 | Meshberg . | |
| 5,102,052 | 4/1992 | Demarest et al. . | |
| 5,110,052 | 5/1992 | Graf et al. . | |
| 5,143,288 | 9/1992 | Kohler et al. . | |
| 5,183,186 | 2/1993 | Delaney, Jr. . | |
| 5,289,952 | 3/1994 | Gueret . | |
| 5,326,000 | 7/1994 | Fuchs . | |
| 5,348,190 | 9/1994 | Mizzi et al. . | |
| 5,348,197 | 9/1994 | Mizzi et al. . | |
| 5,348,198 | 9/1994 | Mizzi et al. . | |

OTHER PUBLICATIONS

Calmar HVD Fact Sheet, Calmar, Inc. Dispensing Systems.
Mark II, Calmar, Inc. Dispensing Systems.
Mark IV Fact Shet, Calmar, Inc. Dispensing Systems.
Mark V, Calmar, Inc. Dispensing Systems.
Magnum 1300, Calmar, Inc. Dispensing Systems "Compressed Air for Aerosol Cans", The New York Times, Monday, Oct. 10, 1994.
Article of Liquid Atomization.
Article on Atomization, by Charles E. Lapple.
"Par-Way's dual-orifice nozzles enhance spray patterns" by Michael L. SanGiovanni, Spray Technology & marketing, Dec. 1992, pp. 39–49.

*Primary Examiner*—Kevin Weldon
*Attorney, Agent, or Firm*—Harness, Dickey & Pierce P.L.C.

[57] ABSTRACT

Improved hand-held, hand-powered spraying devices are provided herein. The improvement provides the ability to spray viscous fluids in an even consistent spray without the use of propellants or outside compressed air or power sources. The spraying apparatus are constructed to provide air delivery to a nozzle assembly, followed by combined air and liquid delivery, followed by air delivery after cessation of liquid delivery, all with a single stroke of a single trigger. One particular apparatus provided is a trigger sprayer which utilizes the compression of dual chambers with a single trigger stroke, and another apparatus is a compression sprayer which utilizes a hand pump and a single container for holding air and liquid. Additionally, a combination pour spout trigger sprayer device is provided.

34 Claims, 5 Drawing Sheets

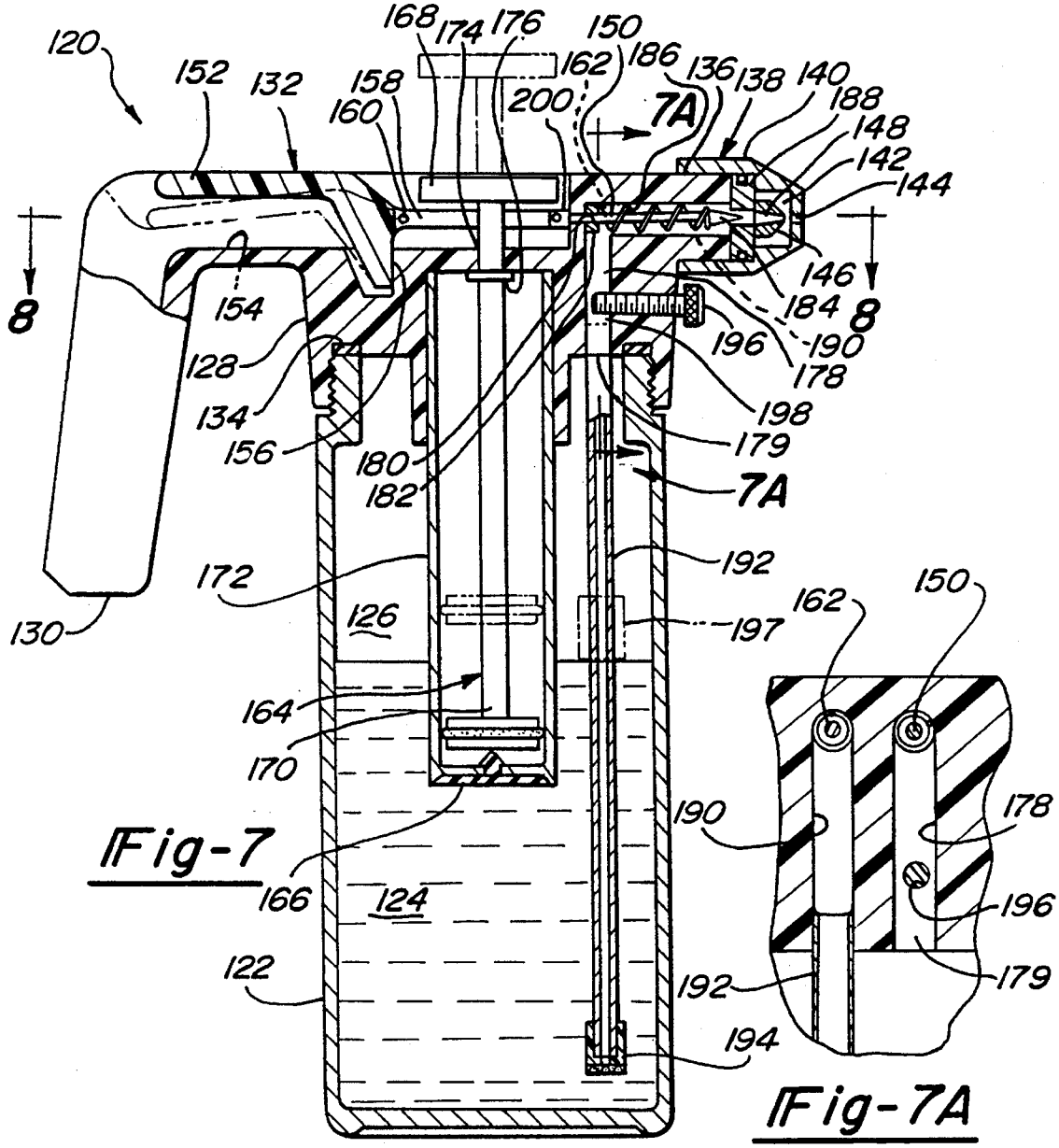
Fig-7
Fig-7A
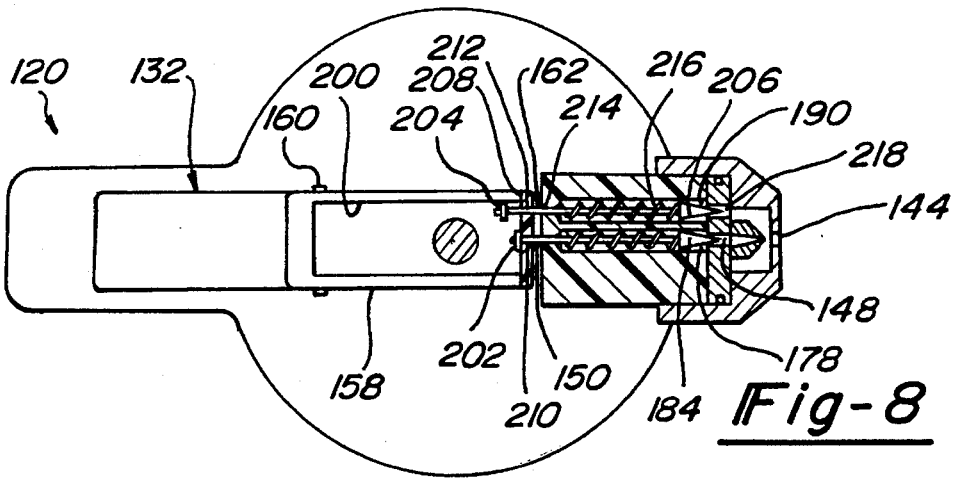
Fig-8

HAND-HELD SPRAYING APPARATUS

FIELD OF THE INVENTION

The present invention relates to spraying apparatus and, more particularly, to hand-held, hand-powered spraying apparatus for dispensing liquids, including viscous liquids.

BACKGROUND

Generally, hand-held hand-powered sprayers such as finger pump sprayers and trigger sprayers achieve atomization by actuation of a finger pump or manually operable trigger which compresses a measured quantity of liquid and forces it under pressure through a swirl chamber and out an exit orifice. Hand-held hand-powered sprayers such as the small compressed air sprayers commonly used in lawn and garden applications rely on a pressurized volume of gas to similarly force liquid under pressure through a swirl chamber and out an exit orifice. In both cases, atomization is achieved as an end result of hand force being applied to the liquid (directly in the case of the trigger sprayer, indirectly in the case of compressed air sprayer). While this type of hydraulic (or pressure) atomization is an effective method for spraying liquids of low viscosity, it is generally inadequate with respect to oils and other viscous liquids.

Because of their increased resistance to disintegration, high viscosity fluids are particularly difficult to atomize. Traditionally, these heavier fluids can be effectively sprayed only by using an external energy source and/or compressed air source (e.g., power painters), in very limited quantities through manually operated sprayers/dispensers that provide mechanical advantage (e.g., fine mist finger pump sprayers that incorporate pre-compression operation), or through pressurized packaging using propellants and/or other gasses (e.g., aerosols). In combination with these methods, thinning agents and/or other additives are often added to the product to further assist atomization of the liquid.

Those systems that rely on external energy and/or compressed air are generally costly, cumbersome and inappropriate for most small applications. Those that rely on mechanical advantage to hydraulically atomize viscous fluids generally can dispense only very small quantities per actuation, may require excessive hand force, and are subject to clogging due to the small diameter passageways the method requires.

Within the context of hand-held, hand-actuatable devices, aerosols succeed in being able to effectively atomize liquids including those of moderately high viscosity. But many drawbacks have been associated with aerosol product delivery systems. Included in these drawbacks are that these systems are often: environmentally hazardous (i.e., they contain HCFCs, CFCs, VOCs); non-recyclable; costly; frequently used in conjunction with thinning agents, alcohols and other synthetic additives that are generally undesirable because they are volatile and can contaminate product purity; and prone to overspray.

While there exist hand-held sprayer devices that utilize air as a secondary agent of atomization (such as U.S. Pat. No. 5,110,052 to Graf et al. issued May 5, 1992) where a volume of air acts on a volume of liquid that has already been hydraulically atomized, there have not been successful attempts at providing hand-held, hand-powered pneumatic sprayers for viscous fluids. Atomization as used herein refers to the mechanical subdivision of a liquid. Pneumatic atomizers as used herein refers to atomizers in which the energy of the gas, generally air, is the primary force causing liquid disintegration.

Additionally, there have been vapor tap sprayers wherein air is introduced into a liquid stream prior to the stream exiting the discharge orifice. In these systems, the liquid/air mix is forced through the discharge orifice under pressure in what remains an essentially hydraulic atomization process. While this approach is effective in some applications, the consistency of the spray is prone to fluctuate as the gas pressure which introduces the gas into the stream is reduced because of draw down during spraying. It is also not clear that air can be efficiently introduced in this way to a stream of viscous media.

Also, dispensing systems are known which have the capability to both spray liquids and pour liquids. An example of such a dual dispensing system is shown in U.S. Pat. No. 4,618,076 issued to Silvenis, Oct. 21, 1986. Such known systems entail a dual dispensing bottle having two openings at the top, one to which a conventional trigger sprayer is attached, the other to which a plug-like apparatus is attached. This system is disadvantageous in that it necessitates specially molding a bottle rather than providing a trigger with an integrated pour spout which can be used interchangeably on a wide range of readily available containers. Bottle as used herein is used interchangeably with container and refers to a receptacle formed from any variety of materials, having any size neck and mouth that can be plugged, corked or capped, wherein capped includes caps of the screw-twist type.

Thus, the discussion above shows recognized deficiencies existing in the field of hand-held, hand-powered sprayers. For instance, there remains a need in the art to provide a hand-held sprayer which can effectively spray viscous fluids such as cooking oils or the like without the use of complex machinery or environmentally undesirable propellants. It is also a goal in the art to provide a hand-held sprayer which provides suitable larger quantities of fluids without severe overspray and while maintaining a hand-held size. It is further a goal to provide a hand-held sprayer having an integrated pour spout which is re-usable and interchangeable and can be attached to any conventional bottle. It also a goal to provide such sprayers in a construction which is simple and cost-efficient to manufacture and use.

SUMMARY OF THE INVENTION

In accordance with the present invention, a hand-held spraying apparatus for spraying a liquid is provided which includes a nozzle and a hand actuatable apparatus. The nozzle comprises a chamber for retaining a substantially unpressurized quantity of liquid available for spraying, an outlet, and a passageway for forcing a gaseous fluid through the quantity of liquid and out through the outlet. The hand actuatable apparatus acts to provide liquid to the chamber and through the outlet to produce a spray from the liquid. Preferably, the actuatable apparatus comprises a means for providing gaseous fluid to the chamber prior to liquid entering the chamber, during spraying of the liquid and after the liquid has stopped entering the chamber. Thus, airflow begins just prior to delivery of liquid, continues during the delivery and ends just after to prevent dripping, to ensure consistency of spray, and to clean the nozzle following discharge, thus preventing clogging.

In one particular embodiment, the hand actuatable apparatus comprises a bottle top sprayer. The bottle top sprayer includes a means for attachment to a bottle, a trigger spraying mechanism and a supply tube for extending into the bottle. The trigger spraying mechanism includes a manually actuatable trigger, a first pump for pumping liquid to the chamber and a second pump for pumping the gaseous fluid, (air), through the liquid via the passage. The first and second pumps are operably associated with the manually actuatable trigger for pumping the liquid and the gaseous fluid through the nozzle in response to a single actuation of the trigger. Also, the pumps are both plunger in cylinder pumps and the second pump has a greater volume of throughput than the first pump. The trigger mechanism operates to actuate the second pump first for initiating airflow to the chamber prior to the liquid reaching the chamber and thereafter actuating the first pump for pumping the liquid to the chamber. The trigger mechanism further operates to maintain airflow via the second pump after cessation of liquid flow via the first pump.

In an alternative embodiment, the second pump is a bellows member, rather than a plunger in cylinder pump, formed between the trigger mechanism and a portion of the sprayer. Operationally, the bellows provides for the same delivery of air just prior, during, and just after delivery of the liquid. Thus, this embodiment provides a simple mechanism requiring a minimum of parts.

In another preferred embodiment, the spraying apparatus includes an integrated pour spout assembly, making possible the dispensing of relatively large volumes of a liquid without having to remove the sprayer assembly from the container. The pour spout assembly comprises a cap assembly, a liquid exit and an air inlet, wherein the liquid exit and air inlet communicate with a source of liquid. The cap assembly, in its closed position, blocks the liquid exit and air inlet to create an air-tight seal. In the open position, liquid freely pours out through the liquid exit, and air is allowed, via the air inlet, to enter the container on which the spraying apparatus is placed.

In yet another alternative embodiment, the hand actuatable apparatus comprises a sealed pressurized container including a gaseous portion and a liquid portion therein. In the container is a first tube in communication with the liquid portion provided for delivering liquid to the nozzle from the liquid portion. The passageway for forcing a gaseous fluid through the liquid is in communication with the gaseous portion of the container. Thus, the container provides gaseous fluid and liquid to the nozzle via discrete channels. In the nozzle, the gaseous fluid and the liquid recombine in the chamber. The liquid is relatively unpressurized in the chamber, whereas the gaseous fluid is travelling at a relatively high velocity. Preferably, the container is pressurized by hand pumping ambient air into the container. The apparatus is constructed so that airflow is followed by combined airflow and liquid flow which is followed by airflow. In one preferred embodiment, the passageway for a gaseous fluid includes a control valve for adjustment of the gaseous flow through the liquid.

The present invention can include various combinations of the above-described embodiments. Furthermore, by providing discrete flows of gas and liquid to the vicinity of the discharge orifice, the present invention can readily accommodate alternative pneumatic nozzle configurations. For instance, such nozzle configurations could include internal gas action or external gas action; multi-jets or single jets; swirl, parallel or cross flow; or any operable combination of these nozzle configurations. Additionally, interchangeable nozzles providing for specific spray patterns, e.g., fan, cone, etc., are contemplated in the present invention.

Accordingly, the present invention is directed to overcoming known deficiencies and shortcomings discussed above by providing a spraying apparatus which achieves pneumatic atomization without the use of an externally supplied compressed air and/or power source. It is further an object of the present invention to provide such a spraying apparatus which is powered by hand using ambient air. It is also an object to provide a spraying apparatus which can spray more viscous liquids than can be sprayed from conventional trigger sprayers. It is further an object to provide a spraying apparatus which can spray larger quantities of viscous fluids, e.g., up to 1 cc or more, than is possible using finger pumps, typically $\leqq$ 0.25 cc.

Another object of the present invention is to provide a spraying apparatus with relatively large diameter channels which are not easily clogged. It is also an object to provide a pneumatic atomizer which first delivers airflow, then combined airflow and liquid flow, followed by airflow so that dripping is prevented. It is further an object to disintegrate the liquid at a relatively unpressurized state with a jet of airflow travelling at a relatively high velocity. Additionally, it is an object to provide high velocity dispersion of smaller quantities of fluid. It is also an object to achieve atomization of viscous fluids without the use of propellants, thinning agents, alcohols, chlorofluoro. carbons, or other volatile organic compounds.

It is also an object of the present invention to be able to manipulate piston sizes, orifice diameters, and nozzle cap specifications and geometries so that the spraying apparatus can be customized for use with specific liquids to maximize performance. It is further an object to provide a reusable, interchangeable spraying apparatus which avoids overspray and underspray, packaging costs and environmental drawbacks associated with aerosol delivery systems.

It is another object of the present invention to provide a spraying apparatus that achieves pneumatic atomization of viscous liquids through the compression of dual chambers containing air and liquid, by actuating a single trigger in a single stroke.

It is another object of the present invention to provide a spraying apparatus that achieves high velocity dispersion of less viscous fluids through compression of dual chambers containing air and liquid, by actuating a single trigger in a single stroke.

It is yet another object of the present invention to provide a spraying apparatus with an integrated pour spout, making possible the dispensing of relatively large volumes of a liquid without having to remove the spraying apparatus from the container.

It is further an object of the present invention to provide a spraying apparatus that achieves pneumatic atomization of viscous liquids by hand pressurization of a single chamber containing air and liquid which are delivered separately to a pneumatic nozzle where they are recombined, actuated by a single trigger stroke.

Additional objects, advantages, and features of the present invention will become apparent from the following description and appended claims, taken in conjunction with the accompanying drawings.

BRIEF DESCRIPTION OF THE DRAWINGS

FIG. 7 is a side sectional view of yet another alternative embodiment of the spraying apparatus according to the present invention;

FIG. 7A is a sectional view of the spraying apparatus according to the present invention taken along line 7A—7A of FIG. 7;

FIG. 8 is a top sectional view of the spraying apparatus according to the present invention taken along line 8—8 of FIG. 7.

DETAILED DESCRIPTION OF THE PREFERRED EMBODIMENTS

In general, the present invention is directed at an improved spraying apparatus which achieves pneumatic atomization without the use of externally supplied compressed air and/or power sources. The spraying apparatus of the present invention are powered by hand using ambient air. The apparatus are constructed such that airflow begins just prior to delivery of liquid and does not end until after delivery of liquid ceases. In this manner the consistency of the spray is ensured, dripping is prevented, and the nozzle is cleaned after each use, thus preventing clogging. A variety of liquids, including viscous liquids, can be sprayed efficiently by using the apparatus according to the present invention. While the spraying apparatus of the present invention is described in association with culinary uses, it will be appreciated that this is merely exemplary of but many uses to which the novel features of the present invention are applicable. It is contemplated that the present invention is also directed at use for dispensing health and beauty care products, household cleaners and polishes, paints and finishes and generally any variety of individual or industrial type lubricants, fluids and other liquid media.

Figure 1:
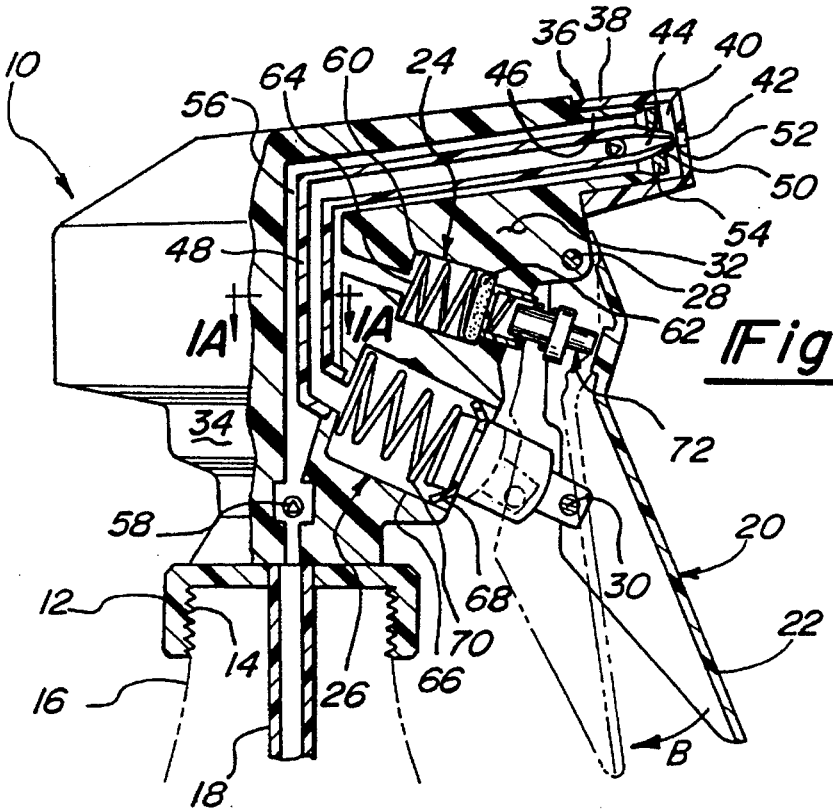
FIG. 1 is a side sectional view of the spraying apparatus according to the present invention.
Figure 2:
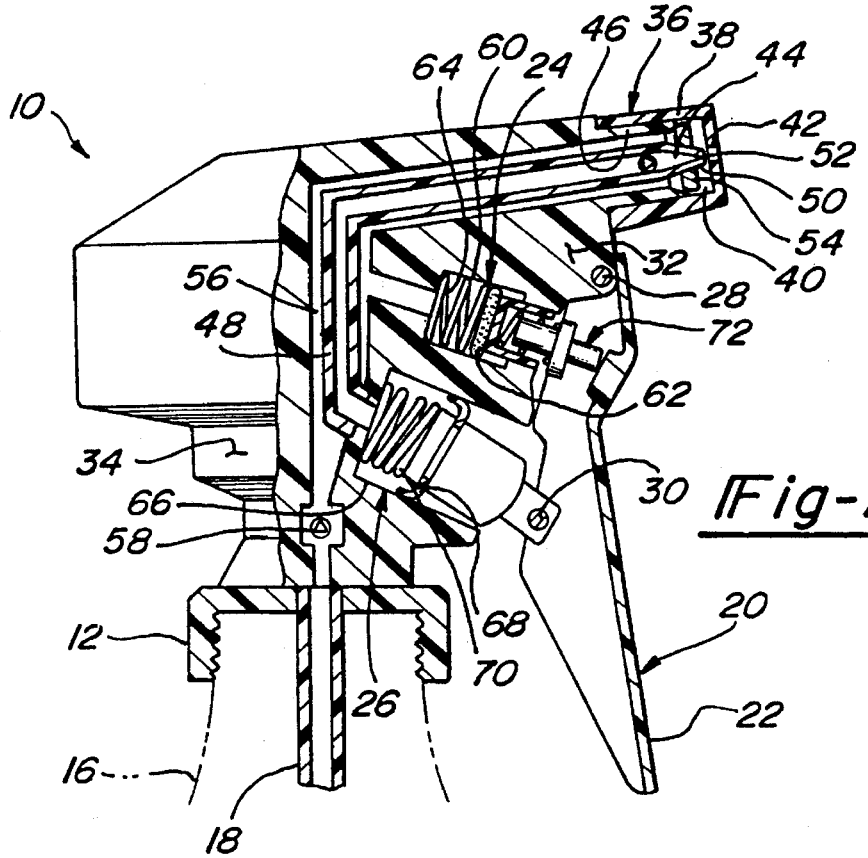
FIG. 2 is a side sectional view of the spraying apparatus shown in FIG. 1 wherein the trigger has been depressed.

Now referring to FIGS. 1 and 2, a side sectional view of a first preferred embodiment of the spraying apparatus according to the present invention is shown in the configuration of bottle top sprayer 10. FIG. 1 shows the sprayer 10 prior to actuation of the trigger 22, whereas FIG. 2 shows sprayer 10 wherein trigger 22 is depressed. Detail of the trigger actuation is discussed below. Sprayer 10 includes a means for attachment 12 to a container 16. Preferably, means for attachment 12 to a container 16 includes threads 14 such that the sprayer 10 can be easily screwed on and off a container (bottle) 16 shown partially by phantom lines. However, it is understood that means for attachment 12 can be any variety of configuration. For example, means for attachment 12 can be a snap-fit type cap, a cork, etc. It is appreciated that means for attachment 12 to a container 16 can be sized as to fit onto a variety of different sized bottles. It is understood that sprayer 10 can be interchanged with other sprayers and that sprayer 10 can be used and re-used on a variety of bottles to spray a variety of liquids. The fit of means for attachment 12 should be snug over a bottle such that no leakage occurs, but sprayer 10 is easily removable and reusable. Sprayer 10 also includes a supply tube 18 extending downwardly into the bottle 16. Supply tube 18 is a cylindrical tube having one end attached to sprayer 10 and one end in contact with a source of liquid when supplied in bottle 16. Preferably, the end of supply tube 18 in contact with the liquid is capped with a filter so that particulates in suspension will not interfere with the spray action. For example, herbs and other flavoring agents can float in oil supplied in bottle 16 without entering supply tube 18.

Still referring to FIGS. I and 2, sprayer 10 further includes a trigger spraying mechanism 20. Trigger spraying mechanism 20 comprises a manually actuatable trigger 22, a first pump 24 and a second pump 26. First pump 24 is for pumping liquid and second pump 26 is for pumping of gaseous fluid, such as ambient air in this example. It is appreciated that the volume capacities of the pumps may vary, but that the throughput of second pump 26 is greater than first pump 24. The ratio of the volume of air to volume of liquid in the subject invention is greater than one to one. Generally, ratios of air to liquid range from greater than about 1:1 to about 100:1. Typically, ratios of from about 4:1 to 50:1 are utilized. Preferably, the ratios of volume of air to volume of liquid per single spray stroke is from about 10:1 to about 40:1. Typically, ratios of between 40:1 and 100:1 are utilized for spraying very small quantities of liquids with such dispersions such as air freshener or the like. In a preferred embodiment, first pump 24 holds a volume of 1 cc of liquid and the second pump 26 holds a volume of 20 cc of gaseous fluid. First pump 24 and second pump 26 are operably associated with trigger 22 for pumping liquid and gas in response to actuation of trigger 22. Preferably, trigger 22 is attached to sprayer 10 by pivots 28 and 30 and extends downwardly from a top front portion 32 of sprayer 10. In this embodiment, sprayer 10 is sized to fit in one hand such that the hand of a user can wrap around the rear bottom portion 34 and actuate trigger 22 with two or three fingers.

Sprayer 10 further includes a nozzle 36 which comprises a nozzle cap 38, a chamber 40 for retaining a substantially unpressurized quantity of liquid available for spraying, an exit orifice 42, and a passageway 44 for forcing a gaseous fluid through the quantity of liquid out exit orifice 42. Nozzle cap 38 fits snugly over a protruding portion 46 of sprayer 10. As will be appreciated, the nozzle cap 38 could be adjustable or may be specifically sized for a certain type of liquid. As shown in the drawings, nozzle cap 38 is snap fit on the protruding portion here, but can be attached by other means known in the art. Protruding portion 46 extends outwardly above top front portion 32 of sprayer 10. Projecting through the center of protruding portion 46 is passageway 44 comprising of gaseous fluid (air) shaft 48 having gaseous fluid nozzle 50 at one end and second pump 26 at the other end. As used herein, shaft refers to a cylindrically shaped passageway. In a preferred embodiment, gaseous fluid nozzle 50 has a smooth conical taper having an inside diameter of about ⅛ inch and tapering over a distance of about ¼ inch to be about 1/32 inch in inside diameter at the gaseous fluid nozzle orifice 52. However, of course, those skilled in the art would readily appreciate that these specifications could be adjusted in accordance with desired results. The taper design is constructed to accelerate the flow of air exiting through the nozzle. The gaseous fluid nozzle 50 is positioned such that air can be forced from second pump 26 through gaseous fluid shaft 48 into gaseous fluid nozzle orifice 52 and out exit orifice 42. Moreover, gaseous fluid nozzle 50 extends beyond protruding portion 46.

Figure 1A:
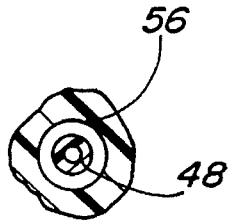
FIG. 1A is a sectional view of the spraying apparatus according to the present invention taken along line 1A—1A of FIG. 1.

Preferably, sprayer 10 is assembled with liquid one-way valve 54 such that once liquid is deposited in chamber 40 it cannot return to bottle 16. Thus, valve 54 preferably surrounds gaseous fluid nozzle 50 and rests on protruding portion 46. Surrounding gaseous fluid shaft 48 is liquid shaft 56. A sectional view of this configuration is shown for clarity in FIG. 1A taken along line 1A—1A of FIG. 1. Liquid shaft 56 has a diameter which allows relaxed flow of viscous fluids without clogging. Liquid shaft 56 extends from and communicates with supply tube 18, to chamber 40. Between bottle 16 and chamber 40, liquid shaft 56 also extends into and communicates with first pump 24. Preferably, liquid shaft 56 is assembled to include one-way valve 58 to facilitate pumping of the liquid.

Still referring to FIGS. 1 and 2, first pump 24 has cylinder 60, plunger head 62, and spring 64. Similarly, second pump 26 has cylinder 66, plunger head 68 and spring 70. Plunger head 68 is designed in a conical flap configuration to function as and provide a one-way air valve. In operation, plunger head 68 blocks air from entering second pump 26 as trigger 22 is compressed. After the stroke is completed and spring 70 is relaxing, plunger head 68 allows air to enter cylinder 66. It is appreciated that second pump 26 can be transversely mounted as well, so long as the pump forces air to travel through a discrete passage at a heightened velocity to chamber 40. First pump 24 is constructed to have a pump delay mechanism 72 system which is described in further detail below in FIGS. 3A, 3B and 3C. Generally, the pump delay mechanism 72 allows for a delay in liquid flow upon initial actuation of the trigger 22 so that air reaches chamber 40 prior to liquid. Additionally, delay mechanism 72 contributes to continuation of airflow during liquid flow and after liquid flow has ceased. Thus, a single stroke of trigger 22 shown by arrow B, actuates airflow followed by combined airflow and liquid flow followed by just airflow.

Figure 3A:
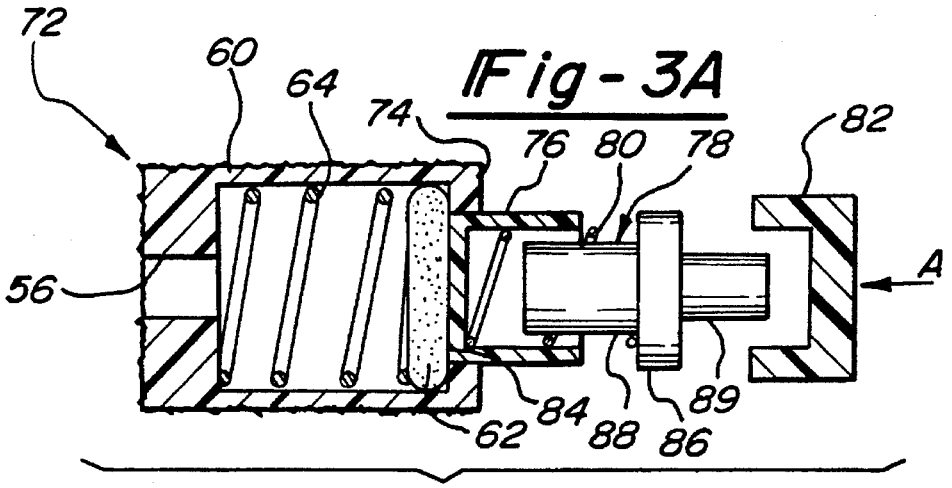
FIGS. 3A, 3B and 3C show an enlarged fragmentary side sectional view of the fluid pump delay mechanism of the spraying apparatus according to the present invention in three different stages.
Figure 3B:
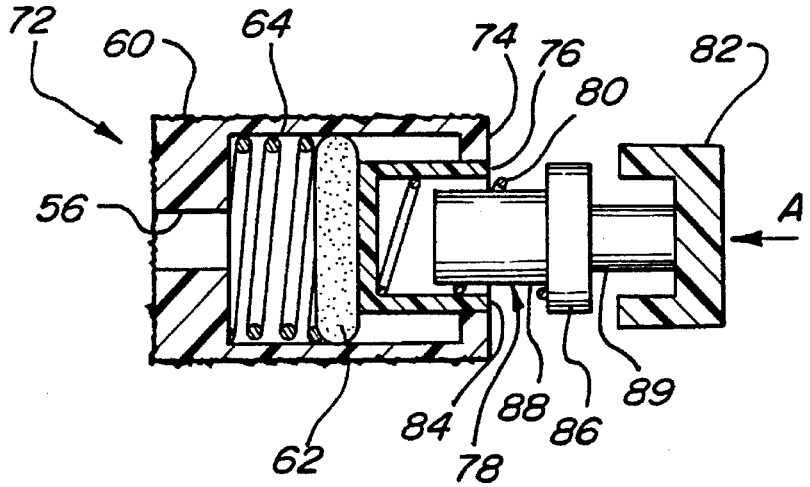
Figure 3C:
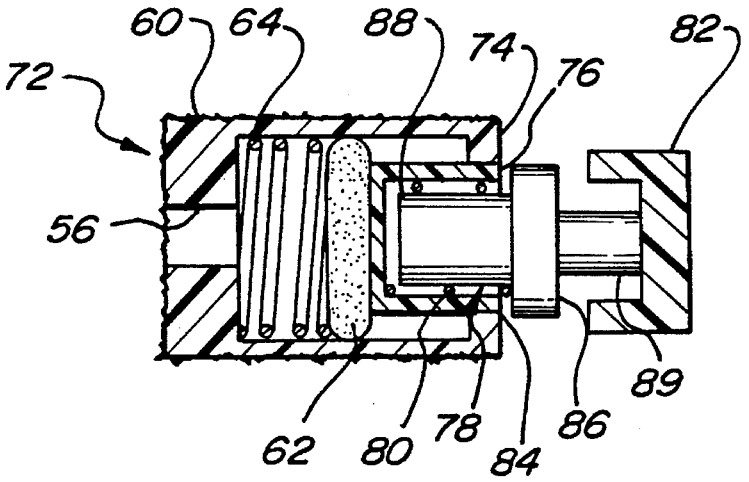

Now referring to FIGS. 3A, 3B, and 3C, an enlarged side sectional view of fluid pump delay mechanism 72 in three different stages of operation is shown. Delay mechanism 72 comprises pump catch 74, second cylinder 76, pump insert 78, insert spring 80, and trigger catch 82. Pump catch 74 extends inwardly from cylinder 60 to create a pump opening 84 smaller in diameter than the widest portion 86 of pump insert 78. Second cylinder 76 slidably fits through pump opening 84 upon compression of pump insert 78. Insert spring 80 surrounds a bottom portion 88 of pump insert 78. Insert spring 80 has a higher spring constant than spring 64 and extends from the widest portion 86 of pump insert 78 to the end of the second cylinder 76. Also, insert spring 80 has a high enough stiffness to not compress until the end of the stroke of the pump insert 78. Opposite the bottom portion 88 is tip portion 89 of pump insert 78. Trigger catch 82 is attached to actuatable trigger 22. (Trigger 22 is shown in FIGS. 1 and 2). Trigger catch 82 is positioned to come in contact with tip portion 89 upon actuation of trigger 22, however, the trigger catch 82 must first travel a distance before engagement. Thus, upon initial actuation of the trigger 22, shown by Arrow A, second pump 26 (of FIG. 1 and 2) is actuated such that airflow begins, but the trigger catch 82 is still traveling. FIG. 3B shows the trigger catch 82 engaged with the pump insert 78, thus pushing second cylinder 76 against plunger head 62 so as to force liquid into chamber 40. (Chamber 40 is shown in FIGS. 1 and 2). In this position, gaseous fluid and liquid is being pumped. FIG. 3C shows the insertion of pump insert 78 into second cylinder 76 upon the continued compression of the trigger. No liquid is pumped as this occurs, but air is still being pumped from second pump 26. Thus, the pump delay mechanisms 72 allows a single trigger to actuate two different pumps at two different times for two different durations upon a single stroke.

Now referring to FIG. 2 again, a side sectional view of sprayer 10 is shown wherein trigger 22 has been depressed along the arrow A shown in FIG. 1. Pump 26 has almost completed ejecting air out shaft 48 and thus out exit 42. Pump 24 has completed pumping liquid out shaft 56 and delay mechanism 72 is working as described above while pump 26 completes its stroke.

Figure 4:
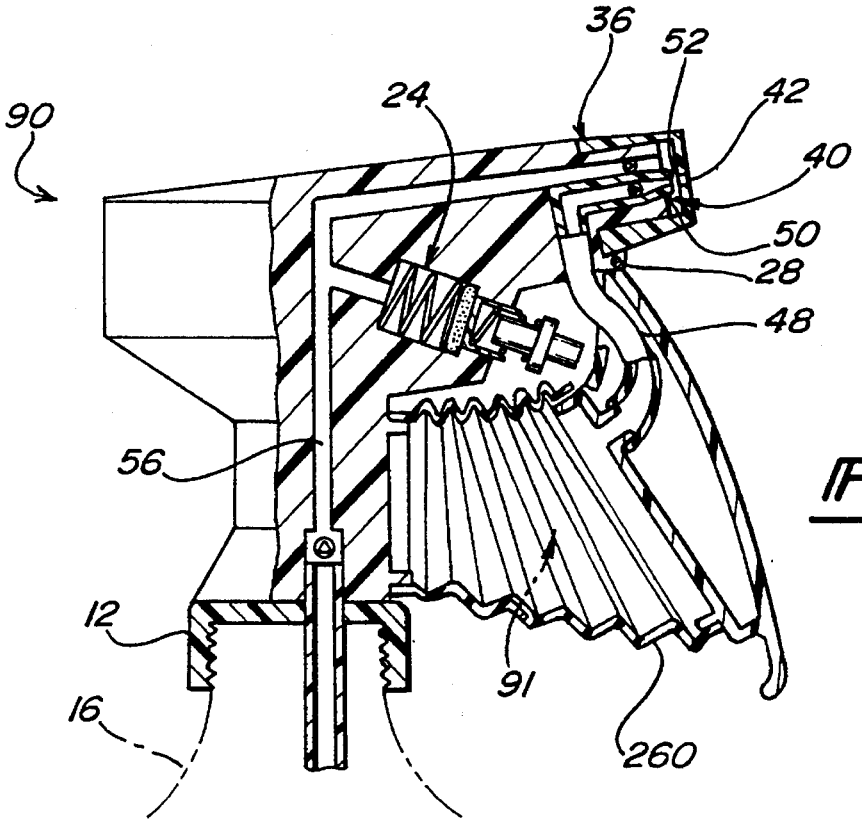
FIG. 4 is a side sectional view of an alternative embodiment of the spraying apparatus according to the present invention.

Now referring to FIG. 4, a side sectional view of an alternative embodiment of the spraying apparatus according to the present invention is shown in the configuration of bottle top sprayer 90. Bottle top sprayer 90 is similar to bottle top sprayer 10 and thus like elements are numbered identically. In this embodiment, second pump 26 is replaced with bellows 260, and gaseous fluid shaft 48 is not surrounded by liquid shaft 56. The design of the bellows is designed to reduce its interior volume at a constant rate. Preferably, bellows 260 holds a volume of 20 cc gaseous fluid, and is formed from rubber. Bellows 260 preferably has flap 91 to function as an one-way air valve. In operation, bottle sprayer 90 is similar to bottle sprayer 10 in that a consistent spray is ensured by the release of gas, combined liquid and gas, and then gas upon actuation of a single trigger with a single stroke.

Figure 5:
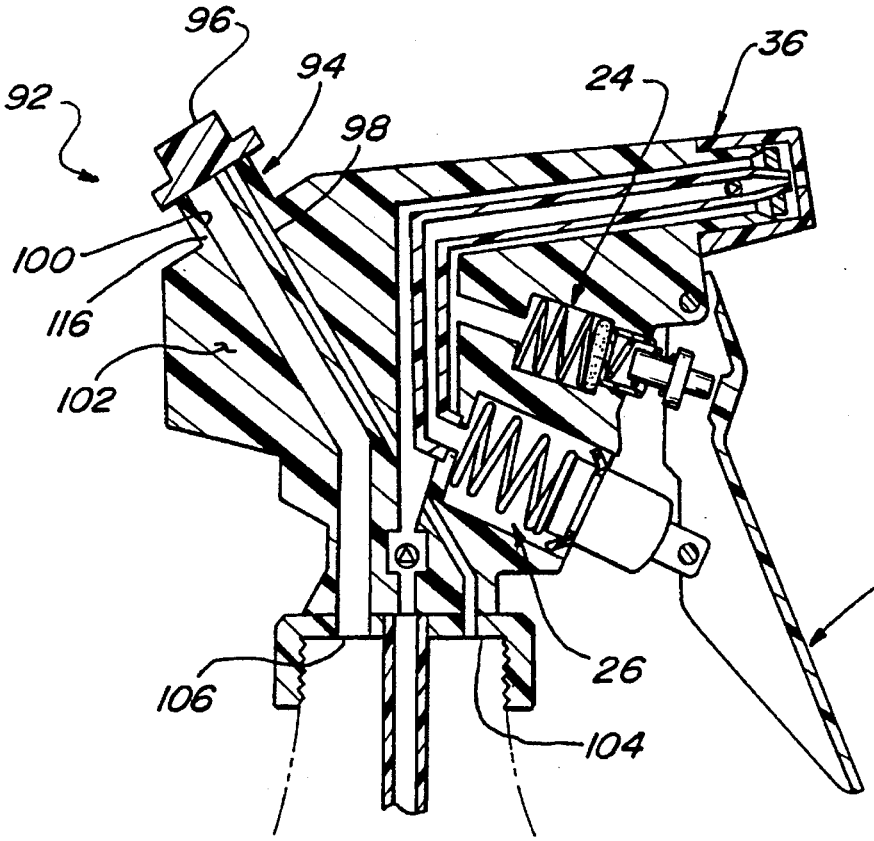
FIG. 5 is a side sectional view of another alternative embodiment of the spraying apparatus according to the present invention.

Now referring to FIG. 5, there is shown an alternative embodiment of the present wherein a spray and pour spout apparatus 92 is provided. Spray and pour spout apparatus 92 is similar to bottle top sprayer 10, and thus like elements are numbered identically. Spray and pour spout apparatus 92 differs from sprayer 10 in that it further includes pour spout 94. Pour spout 94 comprises cap 96, air inlet 98 and liquid exit 100. Pour spout 94 forms a protrusion 116 on a back top portion 102 of spray and spout apparatus 92. In a preferred embodiment, pour spout 94 is generally 180° away from nozzle 36 and trigger 22. Air inlet 98 and liquid exit 100 extend from pour spout 94 to openings (bores) 104 and 106, respectively.

Figure 6A:
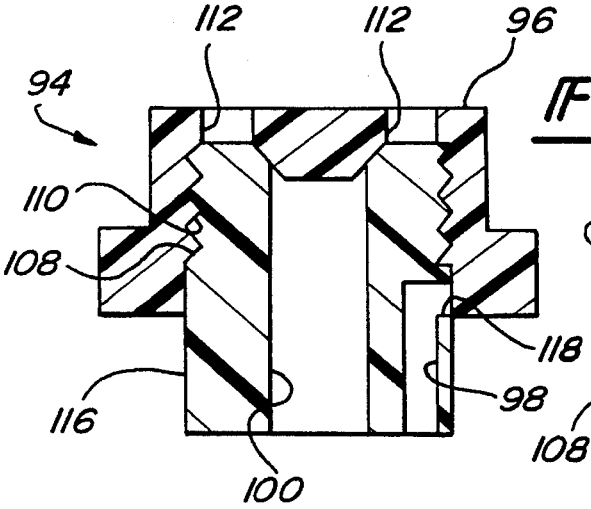
FIG. 6A is a side sectional view of a portion of the integrated pour spout assembly of the spraying apparatus shown in FIG. 5, in the closed position.
Figure 6B:
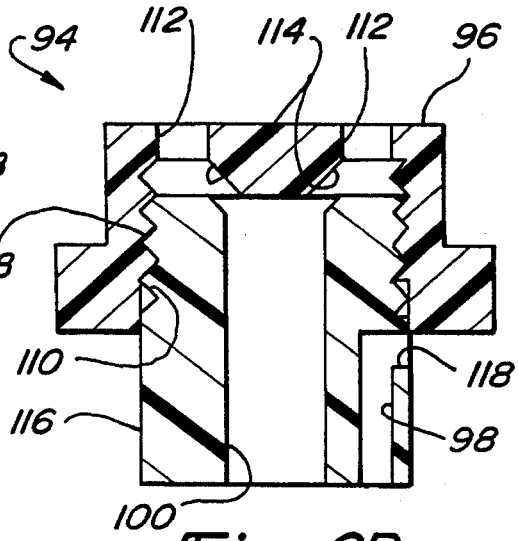
FIG. 6B is a side sectional view of a portion of the integrated pour spout assembly of the spraying apparatus shown in FIG. 5, in the open position.
Figure 6C:
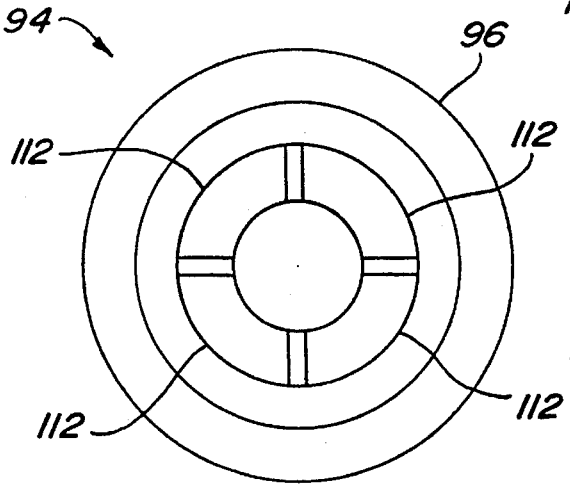
FIG. 6C is a top view of the integrated pour spout assembly of the spraying apparatus shown in FIG. 5.

Now referring to FIGS. 6A, 6B, and 6C, a detailed view of pour spout 94 is shown. FIG. 6A shows spout 94 in the closed position, and FIG. 6B shows spout 94 in the open position. In this particular embodiment, cap 96 is a twist cap having threads 108 to be screwed onto protrusion 116 having threads 110. Cap 96 has exit holes 112. Liquid exit 100 extends through protrusion 116 and when the cap 96 is twisted into its open position, chamber 114 is created, and liquid exit 100 communicates with exit holes 112. Air inlet 98 extends to an opening 118 in the side of protrusion 116 below cap 96 in the open position, as shown in FIG. 6B. Opening 118 is covered by cap 96 when cap 96 is in its closed position, as shown in FIG. 6A. In operation, the cap 96 is twisted so that the exit holes 112 communicate with liquid exit 100. By attaching the spray and pour spout 92 to a bottle with liquid therein and tipping the bottle, liquid is poured out the exit holes 112 while air is allowed to enter into the air inlet 98 through openings 118. Thus, the present invention provides for an integrated pour spout to permit the dispensing of larger quantities of liquid without having to remove the sprayer assembly. For example, a bottle of vegetable oil could in one application be used to spray a frying pan and then used to dispense ½ cup of oil for use in a recipe. Similar needs may exist in the industrial marketplace such as for cleaning fluids, lubricating oil, etc, or the artistic marketplace such as for glues, paints, starches, etc.

Now referring to FIG. 7, a compression sprayer 120 according to an alternative embodiment of the present invention is shown. Sprayer 120 is shown mounted on a container 122 having a liquid portion 124 and air portion 126 therein. In its mounted position, sprayer 120 seals container 122. Sprayer 120 includes mounting 128, handle 130 and trigger 132. Preferably, seal 134 rests between mounting 128 and container 122 to ensure that air cannot leak out. Handle 130 extends in generally an opposite direction from protrusion 136 wherein nozzle 138 is at. Thus, a user should be able to lift the container 122 by the handle 130 and point the nozzle 138 in the direction forward from the hand for easy to spray use.

Still referring to FIG. 7, nozzle 138 comprises nozzle cap 140, chamber 142, exit orifice 144, and air nozzle 146. Nozzle cap 140 fits snugly over protrusion 136. Cap 140 is formed from plastic or any suitable metals, depending on the desired use. Chamber 142 surrounds air nozzle 146. In a preferred embodiment, air nozzle 146 is a smooth conical taper which begins at about ⅛ inch inside diameter and tapers to about 0.032 inch inside diameter over ¼ inch distance. The particular measurements of the taper may vary as desired. This design forces acceleration of the air exiting. The exit orifice 144, the passage 148 within the air nozzle 146 and the chamber all communicate with the air portion 126 in container 122 when first impinger valve 150 is pulled open by depression of trigger 132.

Trigger 132 is depressed by pressing lever 152 into indentation 154 in handle 130. Wall 156 of trigger 132 then acts against the mounting 128 to pull arm 158 of trigger 132 back away from the nozzle 138. Preferably, wall 156 is connected to arm 158 by pivot 160. First impinger valve 150 and second impinger valve 162 (behind valve 150) are operably associated with arm 158 and thus trigger 132. Thus arm 158 includes a slot 200 (discussed in more detail below) for catching impinger valves 150 and 162 and allowing air pump 164 to pass through. Air pump 164 is preferably formed with one-way valve 166. Generally, a variety of air pumps known in the art are suitable for use on this spray system. For example, suitable pumps include those of the type used in the following known sprayer devices: HUDSON HANDY SPRAYER, Model No. 69142; RL FLOWMASTER, Model No. 1998; and CHAPIN multi-purpose sprayer, Model No. 1002. However, it will be readily appreciated by those skilled in the art that other pumps could be used depending on, for instance, the desired size of the finished sprayer. Generally, air pump 164 is designed to pump ambient air into container 122 by lifting handle 168 and then pushing handle 168 downwardly such that piston 170 pushes air into container 122 via one-way valve 166 for pressurizing the gaseous portion 126. Liquid portion 124 cannot come into cylinder 172. Mounting 128 has pump hole 174 for piston 170 to slide through but has seal 176 to keep the fit snug.

Still referring to FIG. 7, air shaft 178 communicates with passage 148 and the pressurized air portion 126 of container 122 at the air intake location 179 so that air can pass from container 122 out the exit orifice 144 when the impinger valve 150 is open. Air shaft 178 surrounds a portion of impinger valve 150 and has a hole 180 for the valve 150 to slide back through when trigger 132 is depressed. Seal 182 keeps air from exiting at hole 180. Impinger valve 150 has tip 184 opposite the end associated with trigger arm 158. Tip 184 is preferably conically shaped and is big enough to depress spring 186 surrounding most of valve 150. Tip 184 blocks passage 148 when the trigger 132 is not depressed. Between air nozzle 146 and valve tip 184 is 0-ring seal 188 in which passage 148 continues through. When trigger 132 is depressed tip 184 is pulled out of passage 148, wherein in trigger 132's resting position, tip 184 blocks the passage 148 and thus the supply of air out through the exit orifice 144. Behind air shaft 178 is liquid shaft 190 which will be discussed in greater detail below and shown in FIGS. 8 and 9. Liquid shaft 190 has a diameter which allows relaxed flow of viscous fluids without clogging. Liquid shaft 190 extends from 0-ring seal 188 to supply tube 192. Supply tube 192 can be formed from plastic, stainless steel, aluminum or any suitable metals, depending on the desired use. Preferably, supply tube 192 is a separate piece which can be screwed or jammed into the mounting 128 at liquid shaft 190. Preferably, filter 194 caps the end of the supply tube 192 which extends downwardly into container 122. FIG. 7A shows a sectional view of FIG. 7 along line 7A—7A to clarify the positioning of air shaft 178, liquid shaft 190, and supply tube 192.

Referring to FIG. 7 again, airflow valve 196 is inserted into valve hole 198 communicating with air shaft 178. Valve hole 198 is positioned clear of the region in which impinger valve 150 occupies. Airflow valve 196 allows the operator to adjust the rate of airflow entering the nozzle 138 (and exiting container 122). Manipulation of the airflow can be achieved by adjusting the airflow valve for particular liquid conditions. Additionally, in yet another preferred embodiment, a control means 197 shown in phantom, is included to adjust the liquid spray.

Figure 9:
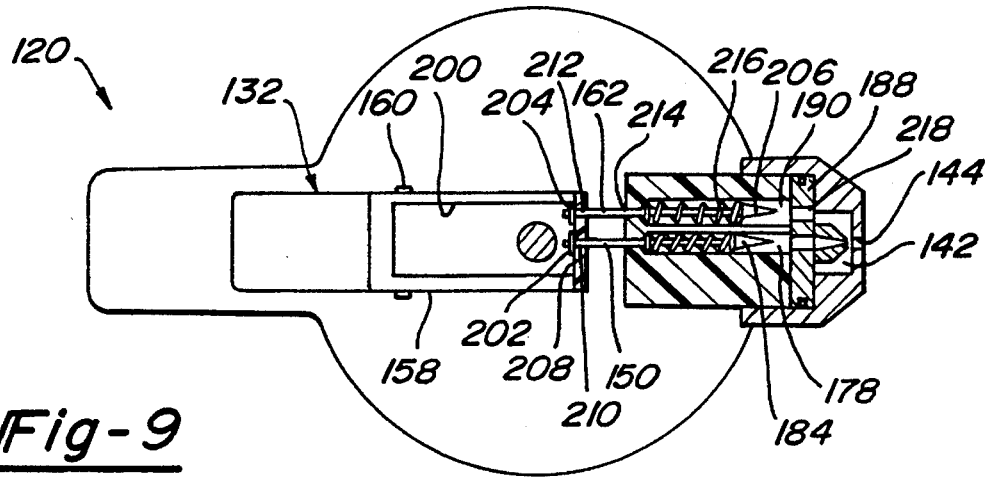
FIG. 9 is the spraying apparatus according to the present invention as shown in FIG. 8, wherein the trigger has been depressed.

Now referring to FIGS. 8 and 9, a top view of the compression sprayer 120 is shown with the pump handle 168 removed. FIG. 8 shows the sprayer 120 in its resting state, and FIG. 9 shows the sprayer 120 during operation, when the trigger 132 is depressed. Slot 200 is formed in trigger arm 158 for catching valves 150 and 162. Valve 150 has stopper 202 on the end away from the tip 184, and valve 162 has stopper 204 on the end away from tip 206. Second impinger valve 162 which is in liquid shaft 190 is slightly longer than first impinger valve 150 which is in air shaft 178. Actuation wall 208 of trigger arm 158 has holes 210 and 212 for valves 150 and 162 to slide through. The holes are smaller than stoppers 202 and 204 so that valves 150 and 162 are pulled back away from exit orifice 144 by actuation wall 208 upon depression of trigger 132. Impinging valve 162 pulls out of liquid shaft 190 through orifice 214. A seal can be placed in the liquid shaft 190 at the orifice 214 to prevent leakage. Surrounding impinging valve 162 from beneath tip 206 to orifice 214 is spring 216. In O-ring 188, is liquid passage 218, aligned with tip 206 and communicating with chamber 142.

In operation, lever 154 is depressed which, via pivot 160, pulls back trigger arm 158 which pulls back actuation wall 208. Actuation wall 208 acts first on impinger valve 150 because it is slightly shorter than impinger valve 162 thus stopper 202 is pulled on before stopper 204. FIG. 8 shows the positioning of the valves 150 and 162 prior to depression of the trigger wherein tip 206 blocks passage 218 and tip 184 blocks passage 148. When impinger valve 150 is pulled on, airflows from container 122 through air shaft 178 though passage 148, chamber 142 and out exit orifice 144. Shortly after impinger valve 150 is pulled on, stopper 204 is hit by actuation wall 208 and valve 162 is pulled on and the passage 218 is opened. FIG. 9 shows both valves open. When passage 218 is open, the chamber 142 fills with liquid such that the pressurized air is forced through a wall of liquid and out exit orifice 144. This provides the improved spray of liquid to the present invention. Once the trigger 132 is released, impinger valve 162 closes passage 218 before impinger valve 150 closes passage 148 because valve 162 is longer than valve 150. Thus, airflow continues after liquid flow has been ceased ensuring continual dispersement of the liquid after exiting orifice 144.

While the above sprayer has been disclosed using a particular novel pneumatic nozzle arrangement, it will be appreciated that the delivery system herein disclosed may also be utilized with other types of pneumatic nozzle configurations. Thus, the novel delivery system may also be used with nozzles that are single jet or multi-jet, parallel flow, crossflow or swirl flow, internal gas action or external gas action, and combinations thereof. Similarly, interchangeable nozzles providing for specific spray patterns, e.g., fan, cone, etc. may also be used.

It is appreciated that a number of variations of the above disclosure can be made without departing from the spirit and scope of the claimed invention.

What is claimed:

1. A hand-held, hand-powered spraying apparatus for pneumatic spraying of a liquid, said apparatus comprising:

a nozzle assembly, said nozzle assembly comprising a chamber for retaining a substantially unpressurized quantity of liquid available for spraying, an outlet, and a passageway for forcing a gaseous fluid through said quantity of liquid and out said outlet;

a hand actuatable apparatus manually actuatable by use of a single hand for providing liquid to said chamber and for forcing a gaseous fluid through said liquid in said chamber and through said outlet to produce a spray from said liquid, said hand actuatable apparatus including a first pump for pumping a liquid fluid to said chamber and a second pump for pumping gaseous fluid through said liquid, said first pump having a limited delivery capacity such that it ceases pumping of liquid prior to ceasing pumping of the gaseous fluid.

2. The apparatus of claim 1, wherein said hand actuatable apparatus comprises a means for providing gaseous fluid to said chamber prior to liquid entering said chamber, throughout spraying of the liquid and continuing after liquid has stopped entering the chamber.

3. The apparatus of claim 1, wherein said hand actuatable apparatus comprises a bottle top sprayer, said bottle top sprayer including a means for attachment to a bottle, a trigger spraying mechanism and a supply tube for extending into the bottle, said trigger spraying mechanism including a manually actuatable trigger, said first and second pumps being operably associated with said manually actuatable trigger for pumping of said liquid and said gaseous fluid through said nozzle in response to actuation of said trigger.

4. The apparatus of claim 3, wherein said second pump has a greater than one to one ratio of throughput volume than said first pump.

5. The apparatus of claim 3, wherein said trigger mechanism operates to actuate said second pump first for initiating airflow to said chamber prior to liquid reaching said chamber and thereafter actuating said first pump for pumping of liquid to the chamber.

6. The apparatus of claim 5, wherein said first pump is a plunger in cylinder pump and said second pump is a bellows member formed between said trigger mechanism and a portion of said sprayer.

7. The apparatus of claim 5, wherein said first pump is a plunger in cylinder type pump having a first volume throughput per stroke and said second pump is a plunger in cylinder type pump having a volume throughput per stroke which is greater than said first pump.

8. The apparatus of claim 1, wherein said first pump is a plunger in cylinder pump and said second pump is a bellows member formed between said trigger mechanism and a portion of said sprayer.

9. The apparatus of claim 1, wherein said first pump is a plunger in cylinder type pump having a first volume throughput per stroke and said second pump is a plunger in cylinder type pump having a volume throughput per stroke which is greater than said first pump.

10. The apparatus of claim 1, wherein said passage includes a frustoconical end portion for accelerating the gaseous fluid to a high velocity jet upon passing through said passage and prior to coming in contact with said liquid.

11. The apparatus of claim 5, wherein said manually actuated trigger is pivotally mounted, said trigger actuating said second pump prior to actuating said first pump.

12. The apparatus of claim 11 wherein said first pump includes a delay mechanism for allowing pivotal movement of said trigger upon reaching the end of a pumping stroke of said first pump such that said second pump can continue to be actuated.

13. A hand-held hand-powered bottle top spraying apparatus for pneumatic spraying of a liquid, said apparatus comprising:

a nozzle assembly, said nozzle assembly comprising a chamber for retaining a substantially unpressurized quantity of liquid available for spraying, an outlet, and a first passageway for forcing a gaseous fluid through said quantity of liquid and out said outlet;

a first pump for pumping liquid;

a means for attachment to a bottle;

a supply tube extending downwardly from a bore in said means for attachment to a bottle;

a second passageway extending from said bore to said chamber, wherein at least one one-way valve is positioned in said second passageway so that said chamber and said supply tube communicate unidirectionally from said supply tube toward said chamber, and wherein said second passageway also communicates with said first pump;

a second pump for pumping gaseous fluid, wherein said second pump is in communication with said first passageway; and a trigger mechanism operably associated with said first pump and second pump wherein upon a single actuation of said trigger mechanism gaseous fluid is forced out said outlet, followed by a combination of gaseous fluid and liquid, followed by gaseous fluid, such that said liquid is consistently atomized throughout a single spray stroke.

14. The apparatus of claim 13 wherein said first passageway is surrounded by said second passageway.

15. The apparatus of claim 13, wherein said first pump comprises a delay mechanism.

16. The apparatus of claim 13, wherein said second pump is selected from a group comprising plunger in cylinder-type pumps and bellows member-type pumps.

17. The apparatus of claim 13, wherein said second pump provides a larger volume of gaseous fluid to said chamber than the volume of liquid provided to said chamber by said first pump per single actuation of said trigger.

18. A hand-held, hand-powered spraying apparatus for pneumatic spraying of a liquid, said apparatus comprising:

a nozzle assembly, said nozzle assembly comprising a chamber for retaining a substantially unpressurized quantity of liquid available for spraying, an outlet, and a first passageway for forcing a gaseous fluid through said quantity of liquid and out said outlet;

a second passageway for delivering liquid to said chamber;

a manually actuable mechanism for actuation with a single hand, including a first pump and a second pump operably associated with said first and second passageways such that upon a single actuation of said trigger mechanism, gaseous fluid is pumped first from said second pump forcing said gaseous fluid to flow from said container first through said first passageway to said chamber and out said outlet and continues to flow as liquid is then forced by said first pump to flow out from said container through said supply tube and second passageway to said chamber and out said outlet and wherein said gaseous fluid flow does not cease until after cessation of said liquid flow.

19. A method of pneumatically spraying a viscous liquid from a hand-held apparatus comprising the steps of:

providing a hand-portable container having a viscous liquid therein;

providing a spraying apparatus removably mounted on said container, said apparatus comprising a nozzle assembly, a trigger mechanism and a first and second chamber, said first chamber for delivering said viscous liquid to said nozzle assembly, said second chamber for delivering a jet of air to said nozzle for causing pneumatic atomization of said viscous liquid, said jet of air having a greater volume than said viscous liquid delivered to said nozzle assembly per spray stroke; and actuating said trigger mechanism to perform said pneumatic atomization in a single spray stroke.

20. The method of claim 19, wherein said nozzle is selected from the group consisting of parallel flow nozzles, crossflow nozzles, swirl flow nozzles, internal gas action nozzles, external gas action nozzles, single jet nozzles, multi-jet nozzles, and any combination thereof.

21. A method of pneumatically atomizing a viscous liquid from a hand-held apparatus comprising the steps of:

providing a nozzle assembly, said nozzle assembly comprising a chamber for retaining a substantially unpressurized quantity of liquid available for spraying, an outlet, and a first passageway for forcing a gaseous fluid through said quantity of liquid and out said outlet;

providing a first pump for pumping liquid;

providing a means for attachment to a bottle;

providing a supply tube extending from a bore in said means for attachment to a bottle;

providing a second passageway extending from said bore to said chamber, wherein at least one one-way valve is positioned in said second passageway so that said chamber and said supply tube communicate unidirectionally from said supply tube toward said chamber, and wherein said second passageway also communicates with said first pump;

providing a second pump for pumping gaseous fluid, wherein said second pump is in communication with said first passageway;

providing a trigger mechanism operably associated with said first pump and second pump wherein upon a single actuation of said trigger mechanism gaseous fluid is forced out said outlet, followed by a combination of gaseous fluid and liquid, followed by gaseous fluid, such that said liquid is consistently atomized throughout a single spray stroke; and actuating said trigger mechanism to perform pneumatic atomization in a single spray stroke.

22. A hand-held manually actuated spraying apparatus for pneumatic spraying of a viscous fluid comprising:

a nozzle assembly;

a hand actuatable apparatus, said hand actuatable apparatus comprising a first pump for delivering of a gaseous fluid to said nozzle and a second pump for delivering a viscous liquid to said nozzle;

said first and second pump being operably associated such that pneumatic atomization of second viscous liquid is provided and said gaseous fluid and liquid are delivered to said nozzle in a ratio of greater than one to one;

said first pump beginning pumping of gaseous fluid immediately prior to and after said second pump pumping liquid to said chamber.

23. The apparatus of claim 22, wherein said ratio of gaseous fluid to liquid is from about 1:1 to about 100:1.

24. The apparatus of claim 22, wherein said ratio of gaseous fluid to liquid is from about 4:1 to about 50:1.

25. The apparatus of claim 22, wherein said ratio of gaseous fluid to liquid is from about 10:1 to about 40:1.

26. The apparatus of claim 22, wherein said hand actuatable apparatus is a trigger sprayer device, said first means is a first pump mechanism and said second means is a second pump mechanism, wherein said first pump and said second pump are actuated by a single stroke of said trigger sprayer.

27. The apparatus of claim 22, wherein the said nozzle is selected from the group consisting of parallel flow nozzles, crossflow nozzles, swirl flow nozzles, internal gas action nozzles, external gas action nozzles, single jet nozzles, multi-jet nozzles, and any combination thereof.

28. The apparatus of claim 22, wherein said first pump is either a plunger type or a bellows type pump.

29. A hand-held, hand-powered spraying apparatus for pneumatic spraying of a liquid, said apparatus comprising:

a bottle top sprayer including a means for attachment to a bottle, a trigger spraying mechanism and a supply tube for extending into the bottle, said trigger mechanism including a manually actuatable trigger;

a nozzle assembly, said nozzle assembly comprising a chamber for retaining a substantially unpressurized quantity of liquid available for spraying, an outlet, and a passageway for forcing a gaseous fluid through said quantity of liquid and out said outlet;

a first pump for providing liquid to said chamber and a second pump for forcing a gaseous fluid through said liquid in said chamber and through said outlet to produce a spray from said liquid in response to manual actuation of said trigger, wherein said first pump is activated for initiating airflow prior to liquid reaching said chamber, said first pump being actuated for pumping of liquid to said chamber, and said first pump has a limited stroke capacity such that it ceases pumping of liquid prior to completion of the pumping of gaseous fluids.

30. The apparatus of claim 29, wherein said second pump has a greater than one to one ratio of throughput volume than said first pump.

31. The apparatus of claim 29, wherein said passage includes a frustoconical end portion for accelerating the gaseous fluid to a high velocity jet upon passing through said passage and prior to coming in contact with said liquid.

32. The apparatus of claim 29, wherein said manually actuated trigger is pivotally mounted, said trigger actuating said second pump prior to actuating said first pump.

33. The apparatus of claim 32, wherein said first pump includes a delay mechanism for allowing pivotal movement of said trigger upon reaching the end of a pumping stroke of said first pump such that said second pump can continue to be actuated.

34. The apparatus of claim 33, wherein said delay mechanism is a lost motion device.

* * * * *